US007637209B2

(12) United States Patent
Bocquet et al.

(10) Patent No.: US 7,637,209 B2
(45) Date of Patent: Dec. 29, 2009

(54) METHOD OF CHANGING THE MOUNTING CONDITION OF A PRINTING MASTER ON A PRINTING MASTER CYLINDER

(75) Inventors: Jacques Bocquet, Linz (FR); Patrick Menu, Breuil le Vert (FR)

(73) Assignee: Goss International Montataire, SA, Montataire (FR)

( * ) Notice: Subject to any disclaimer, the term of this patent is extended or adjusted under 35 U.S.C. 154(b) by 430 days.

(21) Appl. No.: 10/572,179

(22) PCT Filed: Sep. 14, 2004

(86) PCT No.: PCT/EP2004/010247

§ 371 (c)(1),
(2), (4) Date: Mar. 16, 2006

(87) PCT Pub. No.: WO2005/025870

PCT Pub. Date: Mar. 24, 2005

(65) Prior Publication Data

US 2007/0022890 A1 Feb. 1, 2007

(30) Foreign Application Priority Data

Sep. 16, 2003 (DE) ..... 103 42 740

(51) Int. Cl.
*B41F 21/00* (2006.01)
*B41F 27/12* (2006.01)

(52) U.S. Cl. ..... 101/415.1; 101/477; 101/484

(58) Field of Classification Search ..... 101/483, 101/484, 485, 415.1, 477, 486
See application file for complete search history.

(56) References Cited

U.S. PATENT DOCUMENTS

| | | | | |
|---|---|---|---|---|
| 5,363,764 | A | 11/1994 | Horiguchi et al. | 101/485 |
| 5,479,859 | A | 1/1996 | Lindner et al. | 101/485 |
| 5,492,062 | A | 2/1996 | Harris et al. | 101/486 |
| 5,595,120 | A | 1/1997 | Métrope | 101/477 |
| 5,749,297 | A | 5/1998 | Recolet et al. | 101/415.1 |
| 5,868,072 | A | 2/1999 | Nishi | 101/415.1 |
| 6,047,641 | A | 4/2000 | Chagnon | 101/415.1 |
| 6,463,852 | B1 | 10/2002 | Chagnon et al. | 101/415.1 |

(Continued)

FOREIGN PATENT DOCUMENTS

| | | |
|---|---|---|
| DE | 42 05 436 | 9/1992 |

(Continued)

*Primary Examiner*—Ren Yan
(74) *Attorney, Agent, or Firm*—Davidson, Davidson & Kappel, LLC

(57) ABSTRACT

A method according to the invention of changing the mounting condition, in particular of mounting or dismounting of a printing master on a printing master cylinder having a first receiving element for the leading edge and a second receiving element for the trailing edge of the printing master includes rotating the printing master cylinder at a first speed, actuating the first receiving element in at least one first phase position and actuating the second receiving element in at least one second phase position. At least between a third phase position and a fourth phase position, the printing master cylinder may be rotated at a second speed, which differs from the first speed. Due to the reduced speed, the window of time for actuating one or both receiving elements can be extended to increase the precision and reliability of the locking and release.

7 Claims, 4 Drawing Sheets

U.S. PATENT DOCUMENTS

| | | | | |
|---|---|---|---|---|
| 6,601,508 | B1 | 8/2003 | Chagnon | 101/415.1 |
| 6,601,509 | B2 | 8/2003 | Noiret et al. | 101/415.1 |
| 2001/0022896 | A1 | 9/2001 | Fukui | 396/564 |
| 2003/0094111 | A1 | 5/2003 | Donges et al. | 101/483 |

FOREIGN PATENT DOCUMENTS

| | | |
|---|---|---|
| DE | 196 11 685 | 11/1996 |
| DE | 102 48 689 | 5/2003 |
| EP | 0 734 860 | 11/1996 |
| JP | 2000-272096 A | 10/2000 |

METHOD OF CHANGING THE MOUNTING CONDITION OF A PRINTING MASTER ON A PRINTING MASTER CYLINDER

CROSS REFERENCE TO RELATED APPLICATION

Priority to German Patent Application No. 103 42 740.6, filed Sep. 16, 2003 and incorporated herein by reference, is claimed hereby.

BACKGROUND OF THE INVENTION

The invention provides a method of changing the mounting condition of a printing master on a printing master cylinder including a first receiving element for the leading edge and a second receiving element for the trailing edge of the printing master, wherein the printing master cylinder is rotated at a first speed and the first receiving element is actuated in at least one first phase position and the second receiving element is actuated in at least one second phase position. In addition, the invention provides a printing unit, in particular in a printing press, which comprises at least one printing master cylinder and a control unit including a processing unit with a memory.

To reproduce various printing images in a printing press, printing image carriers or printing masters generally referred to as printing forms or printing plates, with varying contents are mounted to printing master cylinders in the printing units of the printing press. To mount and dismount a printing master, the printing master cylinder is rotated at a constant speed. Receiving elements, which may be integrated, if desired, to form a mounting device, are provided for the leading edge and the trailing edge of the printing master. The receiving elements are actuated to lock or release the leading edge and the trailing edge, respectively, of the printing master in anticipation of the required phase position (i.e. the rotary position, the angular position, or the orientation) of the printing master cylinder relative to a zero position of the press or a point of contact with a transfer cylinder, especially a blanket cylinder, or a printing master changing device.

The document JP 2000-272096A discloses a method of mounting and a method of dismounting a printing master. For the printing master to be inserted into or removed from the receiving elements, which are embodied as clamping bars, the printing press is stopped in a defined phase position.

BRIEF SUMMARY OF THE INVENTION

An object of the present invention provides a method of changing the mounting condition of a printing master on a printing master cylinder to be carried out quickly while allowing an extended period of time for the actuation of receiving elements.

According to the invention, this object may be attained by a method of changing the mounting condition of a printing master on a printing master cylinder with the features set forth in claim 1.

In a method according to the invention of changing the mounting condition of a printing master on a printing master cylinder having a first receiving element for the leading edge and a second receiving element for the trailing edge of the printing master, the printing master cylinder may be rotated at a first speed. In at least one phase position (at a first instant), the first receiving element is actuated, and in at least one second phase position (at a second instant), the second receiving element is actuated. At least during the period of time between a third phase position (at a third instant) and a fourth phase position (at a fourth instant), the printing master cylinder is rotated at a second speed that differs from the first speed. As a printing master is mounted, the speed is reduced after the printing master has been brought into contact with the printing master cylinder, and the speed is increased after the first receiving element for the leading edge has been closed. As a printing master is dismounted, the speed is reduced to a first value after holding elements have been brought into contact with the printing master and the speed is increased after the second receiving element has been opened.

The speeds may not be zero. The second speed is preferably lower than the first speed. The second speed may be close to zero. The receiving elements may be clamping elements. The receiving elements may be integrated to form a receiving device. The mounting condition (i.e. the manner in which the printing master is fixed or locked in position) may be at least one first condition in which the printing master is fixed, received, or locked on the printing master cylinder, and at least one second condition, in which the printing master is not located on the printing master cylinder. At least one of the receiving elements is actuated in the period of time between the third phase position and the fourth phase position. In other words, the third instant occurs before the first instant or the second instant, whereas the fourth instant occurs later.

In the method according to the invention, the change of the mounting condition may consist of mounting or dismounting a printing master.

The invention advantageously provides a simplification of an anticipation or a precontrol of the motion of the actuators for the receiving elements: if the speed is reduced during the period of time between the third and fourth phase positions, the window of time for actuating one or both of the receiving elements may be increased. Thus in the case of a mounting operation the locking, in particular the insertion of the trailing edge of the printing master, and in the case of a dismounting operation the release may become more precise and more reliable.

Furthermore, as the material ages, the mechanical parts of the receiving elements may be subject to variations caused by dirt, wear, sticking together, or a change in the actuating time of electrical sliders. These deviations in the actuating, control, and activation behavior of the receiving elements can advantageously be counteracted by changing the rotary speed of the printing master cylinder at precisely the instant when the rotary movement is matched with the actuation of the receiving elements. Even after prolonged use of the printing press, a printing master can thus be mounted and dismounted in a reliable, precise manner, and in particular, the trailing edge of the printing master can be reliably gripped and released.

The method according to the invention may be particularly advantageous for a printing press with printing units that are individually driven and permit a printing master change in individual printing units independently of the others. The rotary speeds of every printing master cylinder can be individually selected, and every printing master cylinder of the number of printing master cylinders can be moved at the second speed in different third and fourth phase positions.

In connection with the method according to the invention, the principle of individual drives may provide a high degree of flexibility for the mounting and dismounting of printing masters. Moreover, the first speed, which is not relevant to the actuation of the receiving elements and consequently for the precision of the method as it is carried out, can advantageously be increased, whereas the second speed may be selected to ensure that the change in the mounting condition (in particular locking or releasing the trailing edge and locking or releasing the leading edge of the printing master) is carried out in a reliable manner.

According to a further development of the idea of the invention, further phase positions, or, to be more precise, pairs of phase positions, may be provided, and in between these phase positions, the printing master cylinder may be rotated at further different speeds, in particular at speeds that are lower than the speed used for the major part of the angular path to be moved through. According to the method of the invention, the printing master may additionally or alternatively be fed to a printing master changing device as the printing master is dismounted or the printing master may be taken from a printing master changing device as it is mounted.

In a first embodiment of the method according to the invention, additionally or alternatively, the speed may be reduced after a holding element for holding the printing master has been disengaged and before the trailing edge is inserted into the second receiving element.

In a second embodiment of the method according to the invention, additionally or alternatively, the speed may be reduced to a second value after a part of the printing master has already been removed from the printing master cylinder, and the speed is increased after the first receiving element has been opened. In an advantageous further development, the speed may be increased essentially to the value it had before it was reduced.

The idea of the invention also provides a method of changing printing masters on a printing master cylinder. In the method according to the invention, a first printing master may be dismounted from the printing master cylinder and a second printing master is mounted to the printing master cylinder. The dismounting of the first printing master or the mounting of the second printing master are carried out in accordance with a method according to the invention as disclosed in the present application.

The method according to the invention or one of its further developments can advantageously be carried out in a printing unit of a printing press in the following manner: in a printing unit according to the invention and including at least one printing master cylinder and a control unit having a processing unit with a memory, a control program for the printing unit is stored in the memory. The control program may comprise at least one part that controls a method according to the invention of changing the mounting condition of a printing master on the printing master cylinder or a method according to the invention of changing printing masters on the printing master cylinder as the part of the program is carried out by the processing unit. The speeds between the individual phase positions of the printing master cylinder as indicated and described may be settable, predeterminable, or changeable by means of the control unit. The printing unit according to the invention may be a direct or indirect lithographic printing unit, an offset printing unit, a dry offset printing unit, a flexographic printing unit, a gravure printing unit, or the like. A printing unit according to the invention can be used in a particularly advantageous manner in a printing press.

A printing press according to the invention may have at least one printing unit according to the invention and may be a web-fed or sheet-fed printing press. Typical printing stock is paper, cardboard, paperboard, organic polymer foil, or fabric, or the like. A web-fed printing press may be a commercial printing press or a newspaper press and may comprise a splicer, a number of printing units with an upper and a lower printing couple (typically four printing units), a drier and chill unit, and a folder. A sheet-fed printing press may be a perfecting press and may comprise a feeder, a number of printing units (typically four, six, eight, or ten), a finishing unit, if desired (an embossing or varnishing unit or the like), and a delivery.

Other advantages and advantageous embodiments and refinements of the invention will be explained on the basis of the following figures and their descriptions.

DETAILED DESCRIPTION

Prior to a detailed explanation of the steps of an advantageous embodiment of the method according to the invention based on FIGS. 1 to 4, it should be noted that to prepare a printing master change in particular in a web-fed printing press, the press operator(s) insert(s) the printing masters of the subsequent print job into printing master changing devices already during a running print job. When the running print job is completed, the press operator selects the printing units for which a printing master change is to be carried out. The running print job ends with a cleaning operation of the printing unit, in particular a blanket washing operation, in the printing units or printing couples.

Figure 1:
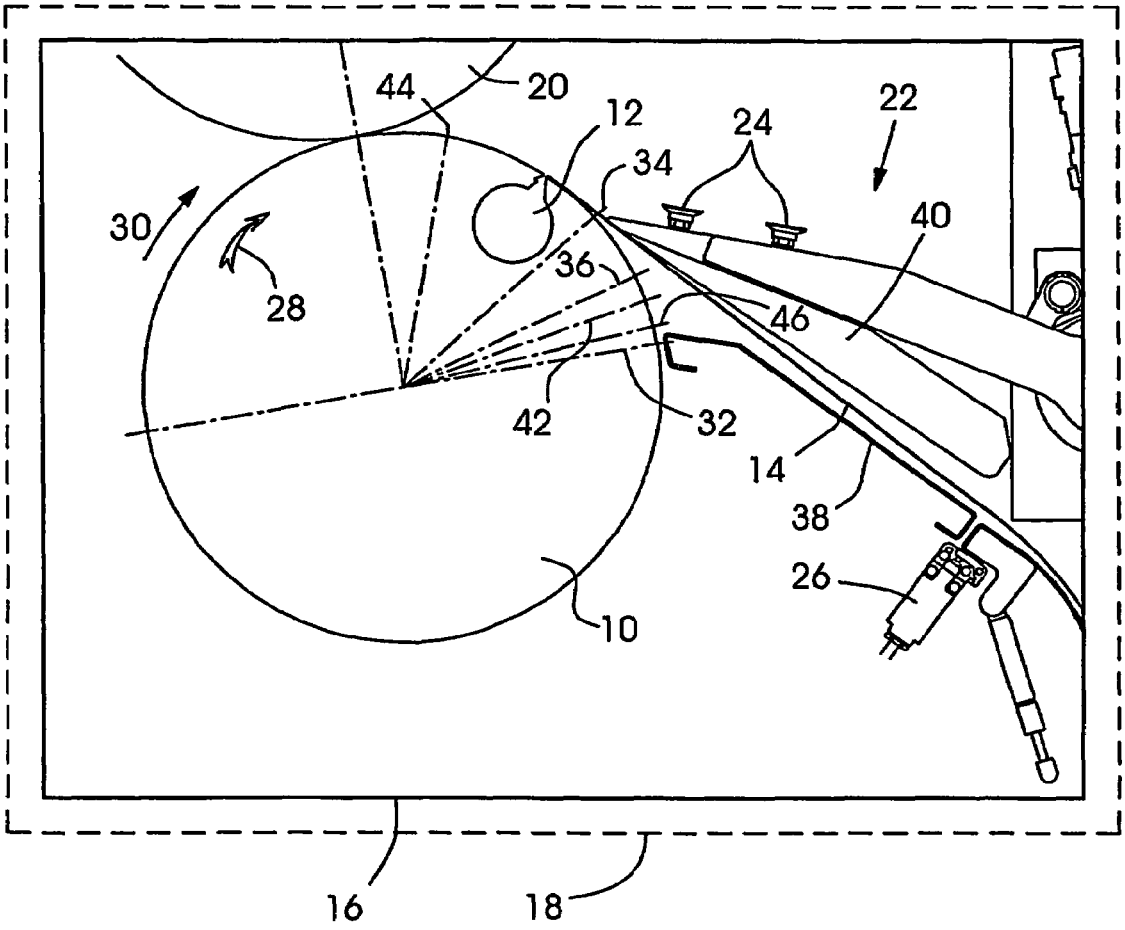
FIG. 1 is used to explain the method steps without speed changes to dismount a printing master in one embodiment at a lower printing master cylinder in a printing unit of a web-fed printing press.
Figure 3:
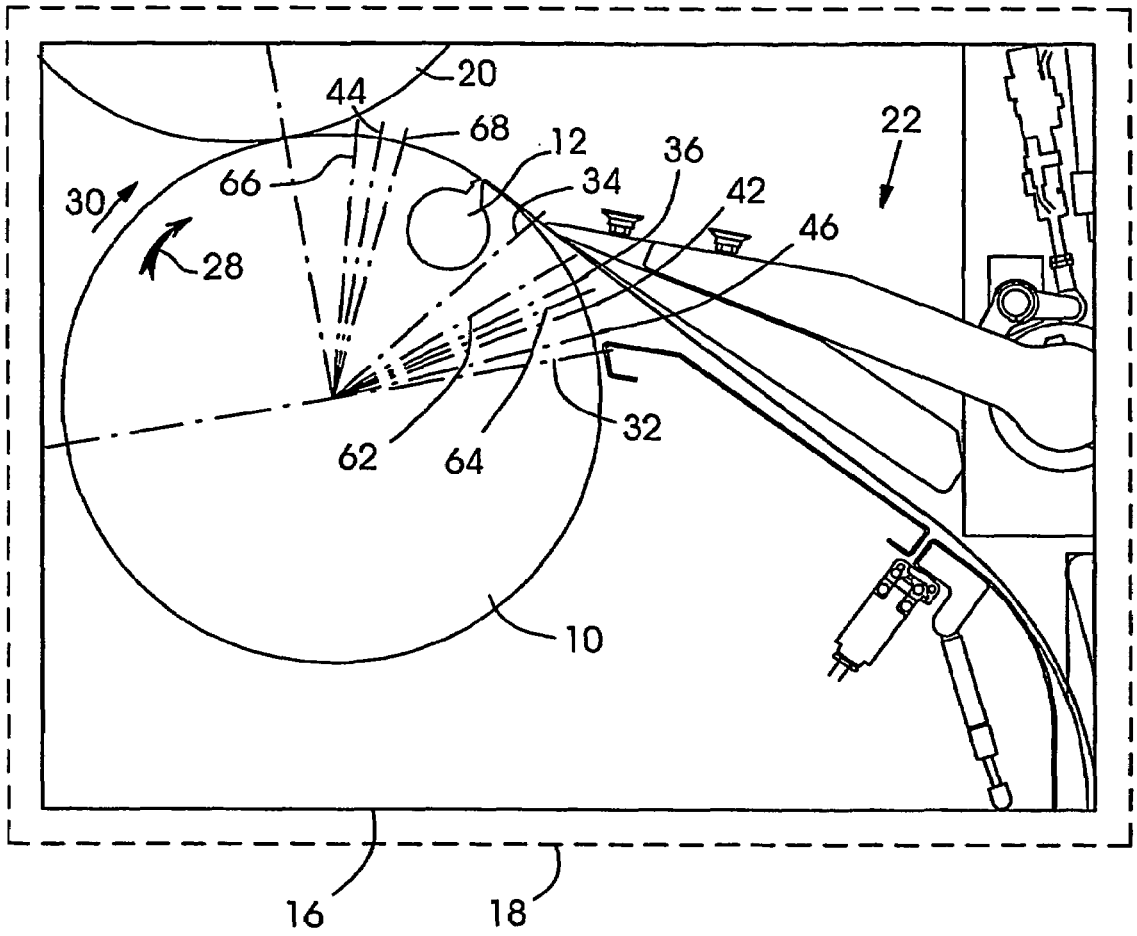
FIG. 3 is used to illustrate an advantageous embodiment of the dismounting method according to the invention with the steps explained with reference to FIG. 1.

FIG. 1 shows a lower printing master cylinder 10 having a locking gap 12 in which receiving elements for the leading edge and the trailing edge of the printing master 14 are located. The receiving elements are integrated to form a receiving device. The printing master cylinder 10 is part of a printing couple or printing unit 16 of a web-fed printing press 18. Receiving elements of this kind are disclosed in U.S. Pat. No. 6,601,509, U.S. Pat. No. 6,601,508, U.S. Pat. No. 6,463,852, U.S. Pat. No. 6,047,641, and U.S. Pat. No. 5,749,297, for example, which are incorporated by reference herein. The printing master cylinder 10 may be engaged with a transfer cylinder or blanket cylinder 20. FIG. 1 shows a printing form changing device 22 with suction heads as holding elements 24 for feeding a printing master. The printing master changing device 22 also includes a sensor 26 for detecting the presence of a dismounted printing master 14. The method steps for dismounting a printing master 14 without speed changes will be explained based on FIG. 1. FIG. 3 will be used to describe the speed changes.

A press operator initiates the dismounting operation by actuating a button or switch of a control unit. An alarm sounds to indicate the start of the operation, which starts with a time delay. After at least one pressure roller in the drier and at least one pressure roller in the unwinding device (splicer) have been engaged and after the web tension has been reduced to essentially zero in the splicer, the button of the control unit is to be actuated again.

In a printing couple or printing unit 16, cooperating printing master cylinders 10 and blanket cylinders 20 are engaged with each other without engaging the two blanket cylinders 20. In a phase position 34 (the angle relative to the zero position 32 of the press) of the locking gap 12, the printing master cylinder is set into a backward motion in the counterdirection of rotation 28 at a first speed 30, for example 3 meters per minute. At a first angle, which is not controllable or settable by the press operator, the printing master changing device 22 is engaged with the printing master cylinder 10. In a phase position 36, the receiving device, in particular the second receiving element for the trailing edge of the printing master 14, is opened. Due to the resilience of the printing master 14 as it rests against the surface of the printing master cylinder 10 in a curved manner, the trailing edge releases from the locking gap 12 so that the trailing edge may move between a first guide element 38 and a second guide element 40 carrying the holding elements 24.

In a phase position 42, the receiving device is closed, in particular if the receiving element for the leading edge was opened with the second receiving element for the trailing edge. A further rotation in the counterdirection 28 progressively moves the printing master 14 into the printing master changing device 22. In a phase position 44, the receiving device, in particular the first receiving element for the leading edge of the printing master 14, is opened, so that the leading edge is released, too. At a second angle, the trailing edge contacts a hook of the printing master changing device 22 and hits a stop. The leading edge releases from the printing master cylinder 10.

At a phase position 46, the rotation of the printing master cylinder 10 is stopped and the receiving device is closed again. After a defined period of time, the printing master 14 that has been dismounted is pulled between guides by means of a lift in order to remove the printing master 14 from the printing master cylinder 10 and to place it in a cartridge, a storage device. The press operator can retrieve it from there when the dismounting operation is completed. The next step is a verification or evaluation of whether the dismounting operation was successful: if the dismounted printing master 14 is detected by the sensor 26, the operation continues without signaling a failure. If no printing master is detected, the operation is interrupted and an output device of the control unit outputs a message. The press operator must interfere to correct the error and to reset the control. A successful dismounting operation may be immediately followed by a mounting operation.

Figure 2:
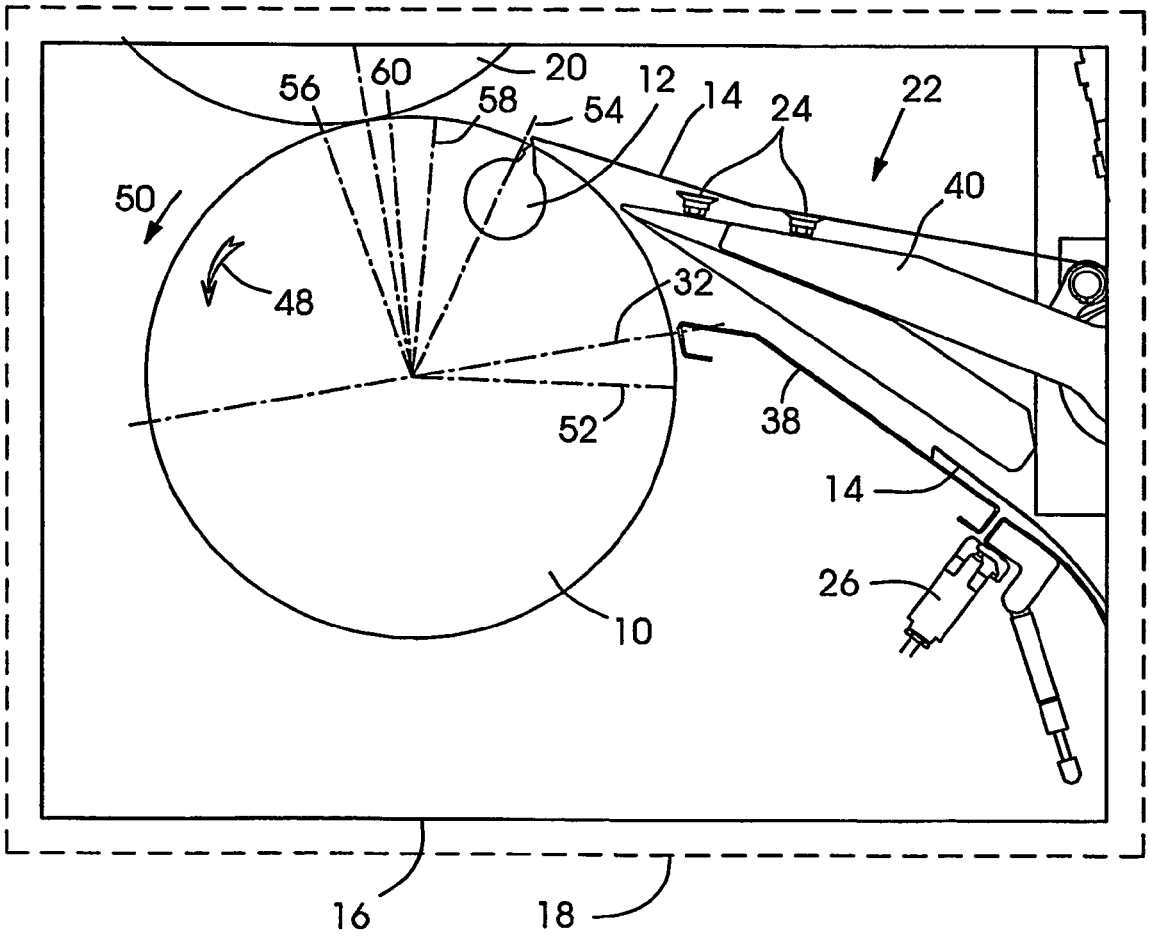
FIG. 2 is used to explain the method steps without speed changes for mounting a printing master in one embodiment at a lower printing master cylinder in a printing unit of a web-fed printing press.

FIG. 2 is used to explain the method steps for mounting a printing master without speed change, which will be explained based on FIG. 4. The geometric aspects of the related components of the printing couple or printing unit 16 have already been explained with reference to FIG. 1.

The press operator initiates the mounting operation by actuating a button or switch of the control unit of the printing couple or printing unit 16. An alarm sounds to indicate the start of the process, which starts with a time delay. After at least one pressure roller in the drier and at least one pressure roller in the unwinding device (splicer) have been engaged and after the web tension has been reduced to essentially zero in the splicer, the button of the control unit is to be actuated again. In a printing couple, cooperating printing master cylinders 10 and blanket cylinders 20 are engaged with each other without engaging the two blanket cylinders 20.

If a dismounting operation has just been carried out, the steps that have just been described can be dispensed with. Instead, the movement of the printing master cylinder 10 may immediately be started in the following manner. The printing master cylinder is set into a forward motion in the direction of rotation 48 at a first speed 50, for example 3 meters per minute. The fixing effect of the holding elements 24, e.g. the suction effect of suction nozzles, for the printing master 14 to be received is activated. In a phase position 52 of the locking gap 12 (relative to a zero position 32 of the press) the printing master changing device 22 is engaged with the printing master cylinder 10 in the printing master mounting position, and the printing master 14 is pressed onto the printing master cylinder 10. At a third angle, the leading edge of the printing master 14 enters the locking gap 12, so that the printing master 14 is entrained with and by the rotating printing master cylinder 10.

In a phase position 54, the receiving device, in particular the first receiving element for the leading edge, is closed, so that the leading edge of the printing master 14 is held. In a phase position 56, the fixing effect of the holding elements 24 is switched off, so that the printing master 14 may be released by the printing master changing device. In a phase position 58 further on in the direction of rotation 48, the receiving device, in particular the second receiving element, is opened to insert the trailing edge of the printing master 14. In a phase position 60, the receiving device, in particular the second receiving element, is closed when the locking gap 12 is located essentially in the extreme position or point of the volume between both cylinders limited by the two cylinders' circumferential surfaces and a tangent plane touching both cylinders' circumferential surfaces (wedge volume), in particular in the point of contact between the printing master cylinder 10 and the blanket cylinder 20, so that the printing master 14 is extended or tensioned and the trailing edge of the printing master 14 is pushed into the locking gap 12 by the blanket cylinder 20. When the phase position 56 is reached again, the rotation of the cylinder is stopped, the printing master changing device 22 is disengaged, and the mounting operation is completed.

After the phase positions of the individual operations for dismounting and mounting a printing master 14 have been described with reference to FIGS. 1 and 2, the variation of the rotary speeds of the printing master cylinder 10 as suggested by the invention will be explained below with reference to FIGS. 3 and 4.

FIG. 3 again shows the printing master cylinder 10 with the blanket cylinder 20 in the printing couple or printing unit 16 of the web-fed printing press 18. This figure is dedicated to explaining the speed variations for dismounting the printing master 10 in accordance with the invention. As mentioned above, to dismount the printing master 14, the printing master cylinder 10 is set into a backward motion in the counterdirection of rotation 28 at a first speed 30, for example 3 meters per minute, in a phase position 34 (the angle relative to the zero position 32 of the press) of the locking gap 12.

According to the invention, the rotary speed is reduced to a second speed, for example 1 meter per minute, in a third phase position 62, after the printing master changing device 22 has been engaged with the printing master cylinder 10. Thus in the phase position 36, when the receiving device is opened, the printing master cylinder 10 rotates only at the reduced second speed, which has the advantages as mentioned above. After releasing the trailing edge of the printing master, the speed is increased again in a fourth phase position 64, in particular to the value of the first speed 30. After the phase position 42, in a fifth phase position 66, the rotary speed of the printing master cylinder 10 is reduced to a third speed, which may or may not essentially correspond to the second speed and may, for example, be 0.5 meters per minute. After further rotation in the counterdirection 28, in particular after passing the phase position 44, the leading edge of the printing master 14 is released. In a sixth phase position 68, the speed is increased again, in particular to the value of the first speed 30.

The dismounting operation is completed in the way already described with reference to FIG. 1.

Figure 4:
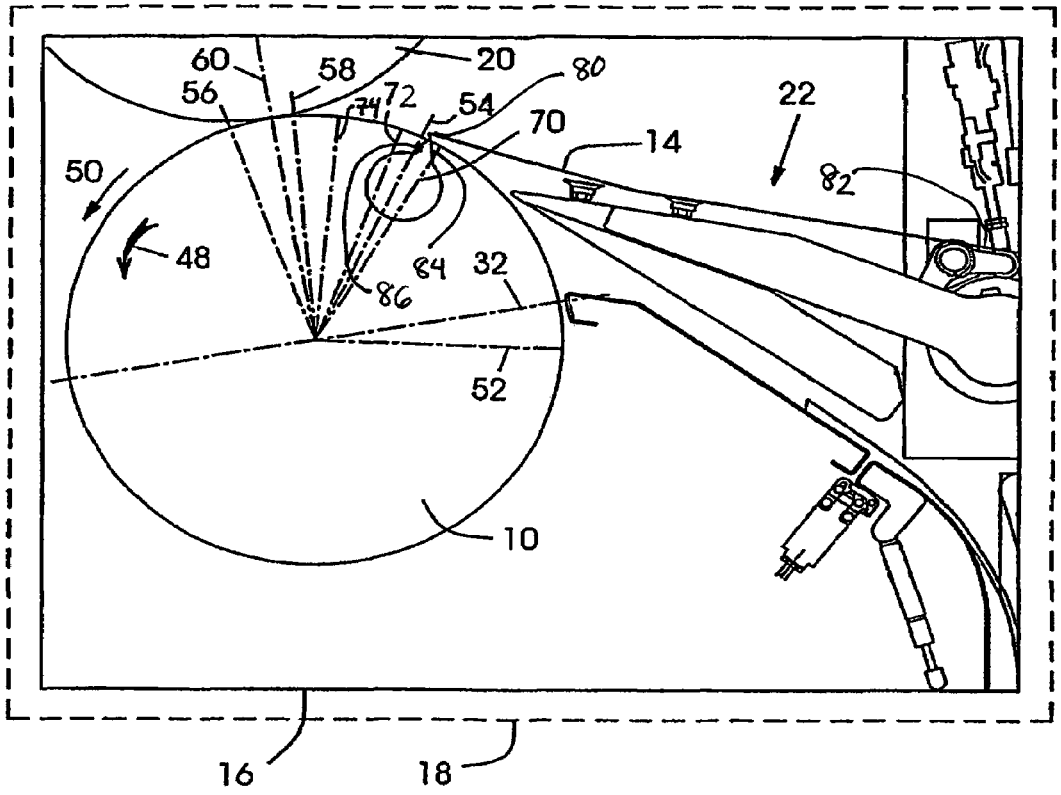
FIG. 4 is used to illustrate an advantageous embodiment of the dismounting method according to the invention with the steps explained with reference to FIG. 2.

FIG. 4 also shows the printing master cylinder 10 which the blanket cylinder 20 in the printing couple or printing unit 16 of the web-fed printing press 18. This figure is dedicated to explaining the speed variations according to the invention for the mounting of a printing master 14. As described with reference to FIG. 2, the printing master cylinder 10 is set into a forward motion in the direction of rotation 48 at a first speed 50, for example 3 meters per minute. In a phase position 52, the printing master changing device 22 is engaged with the printing master cylinder 10.

According to the invention, the rotary speed is then reduced to a second speed, for example 0.5 meters per minute, in a third phase position 70. After the phase position 54, in which the receiving device, in particular the first receiving element for the leading edge, is closed, the speed is increased again, in particular to the value of the first speed 30, in a fourth phase position 72. As the printing master cylinder 10 now rotates through more than one complete revolution, the locking gap passes the phase position 56 and reaches a fifth phase position 74, in which the rotary speed of the printing master cylinder 10 is reduced to a third speed, which may or may not essentially correspond to the second speed and may be 0.5 meters per minute, for example. Consequently, the second receiving element can be closed as described with reference to FIG. 2 to lock the trailing edge, but at a reduced speed, which has the advantages mentioned above.

In short, the rotary speed of the printing master cylinder is reduced as at least one receiving element for the leading edge or the trailing edge of the printing master is opened or closed to provide a reliable locking or a reliable release of the locking action, as it has been described based on the embodiment of the method according to the invention shown in the figures.

LIST OF REFERENCE NUMERALS

10 printing master cylinder
12 locking gap
14 printing master
16 printing couple
18 web-fed printing press
20 blanket cylinder
22 printing master changing device
24 holding element
26 sensor
28 counterdirection of rotation
30 first speed 32 zero position of the press
34 phase position
36 phase position
38 first guide element
40 second guide element
42 phase position
44 phase position
46 phase position
48 direction of rotation
50 first speed
52 phase position
54 phase position
56 phase position
58 phase position
60 phase position
62 third phase position
64 fourth phase position
66 fifth phase position
68 sixth phase position
70 third phase position
72 fourth phase position
74 fifth phase position

The invention claimed is:

1. A method of changing the mounting condition of a printing master on a printing master cylinder, the printing master including a leading edge and a trailing edge, the printing master cylinder including a leading receiving element for receiving and releasing the leading edge and a trailing receiving element for receiving and releasing the trailing edge, the method comprising:

mounting a printing master including the successive steps of:

rotating the printing master cylinder at a first mounting speed;

reducing the speed of the printing master cylinder from the first mounting speed to a second mounting speed at a leading reducing speed phase position of the printing master cylinder;

closing the leading receiving element in a leading closing phase position of the printing master cylinder to hold the leading edge of the printing master, the printing master cylinder being rotated with the second mounting speed during closing of the leading receiving element;

increasing the speed of the printing master cylinder from the second mounting speed during an acceleration phase position;

reducing the speed of the printing master cylinder to a third mounting speed at a trailing reducing speed phase position; and closing the trailing receiving element at a trailing closing phase position to hold the trailing edge of the printing master while the printing master cylinder is rotated with the third mounting speed:

dismounting the printing master including the successive steps of:

rotating the printing master cylinder at a first dismounting speed;

reducing the speed of the printing master cylinder from the first dismounting speed to a second dismounting speed at a dismount trailing reducing speed phase position of the printing master cylinder;

opening the trailing receiving element at a trailing opening phase position of the printing master cylinder to release the trailing edge of the printing master, the printing master cylinder being rotated with the second dismounting speed during opening of the trailing receiving element; and increasing the speed of the printing master cylinder from the second dismounting speed during a dismount acceleration phase position.

2. The method recited in claim 1, further comprising the successive steps of:

reducing the speed of the printing master cylinder to a third dismounting speed at a dismount leading reducing speed phase position after the dismount acceleration phase position; and opening the leading receiving element at a leading opening phase position to release the leading edge of the printing master.

3. The method according to claim 1, wherein the printing master is fed to a printing master changing device as the printing master is dismounted or the printing master is taken from a printing master changing device as the printing master is mounted.

4. The method according to claim 1, wherein during mounting of the printing master, the speed is reduced after a holding element of the printing master has been disengaged and before the trailing edge is inserted into the trailing receiving element.

5. The method according to claim 1, wherein during dismounting of the printing master, the speed is reduced to a third dismounting speed after a part of the printing master is removed from the printing master cylinder and the speed is increased after the leading receiving element is opened.

6. The method according to claim 5, wherein the speed is increased essentially to the first dismounting speed.

7. A method of changing printing masters on a printing master cylinder with a first printing master being dismounted from the printing master cylinder and a second printing master being mounted to the printing master cylinder, wherein the dismounting of the first printing master or the mounting of the second printing master is carried out in accordance with a method as set forth in claim 1.

* * * * *